US008404139B2

(12) United States Patent
Dubois et al.

(10) Patent No.: US 8,404,139 B2
(45) Date of Patent: Mar. 26, 2013

(54) CONDUCTING FLUID CONTAINING MICROMETRIC MAGNETIC PARTICLES

(75) Inventors: Emmanuelle Dubois, Paris (FR); Jean Chevalet, Ivry sur Seine (FR)

(73) Assignees: Universite Pierre et Marie Curie, Paris (FR); Centre National de la Recherche Scientifique, Paris (FR)

( * ) Notice: Subject to any disclaimer, the term of this patent is extended or adjusted under 35 U.S.C. 154(b) by 962 days.

(21) Appl. No.: 11/922,419

(22) PCT Filed: Jun. 26, 2006

(86) PCT No.: PCT/FR2006/001470

§ 371 (c)(1),
(2), (4) Date: Dec. 28, 2008

(87) PCT Pub. No.: WO2007/000510

PCT Pub. Date: Jan. 4, 2007

(65) Prior Publication Data

US 2009/0134354 A1 May 28, 2009

(30) Foreign Application Priority Data

Jun. 27, 2005 (FR) ..... 05 06510

(51) Int. Cl.
*C10M 171/00* (2006.01)

(52) U.S. Cl. ..... 252/62.52; 420/526; 252/62.51 R; 252/62.55

(58) Field of Classification Search ..... 420/526; 252/62.52, 62.51 R, 62.55
See application file for complete search history.

(56) References Cited

U.S. PATENT DOCUMENTS

| | | | | |
|---|---|---|---|---|
| 2,974,104 | A | 3/1961 | Paine et al. | |
| 3,130,044 | A | 4/1964 | Flindt | |
| 3,208,920 | A | 9/1965 | Crew | |
| 3,289,126 | A * | 11/1966 | Hurvitz | 335/47 |
| 4,315,827 | A * | 2/1982 | Bottenberg et al. | 252/62.51 R |
| 5,382,373 | A * | 1/1995 | Carlson et al. | 252/62.55 |
| 6,027,575 | A * | 2/2000 | Paruchuri et al. | 148/24 |
| 6,531,270 | B1 * | 3/2003 | Olson et al. | 430/391 |
| 6,942,957 | B2 * | 9/2005 | Ray et al. | 430/271.1 |
| 7,393,463 | B2 * | 7/2008 | Ulicny et al. | 252/62.52 |
| 7,724,433 | B2 * | 5/2010 | Nakayama et al. | 359/483.01 |
| 2009/0289214 | A1 * | 11/2009 | Kieburg et al. | 252/62.52 |
| 2010/0092419 | A1 * | 4/2010 | Guerrero-Sanchez et al. | 424/78.08 |

FOREIGN PATENT DOCUMENTS

| | | | |
|---|---|---|---|
| JP | 2006-193686 | * | 7/2006 |
| WO | WO 2004/050350 | * | 6/2004 |
| WO | WO 2006/132252 | * | 12/2006 |

OTHER PUBLICATIONS

Arias et al, "Preparation and Chararcterization of carbonyl iron/poly(butylcyanoacrylate) core/shell nanoparticles", Jour. Colloid and Interface Science, 299, 2006, pp. 599-607.*

Ito et al, "MR Fluid of Liquid Gallium Dispersing Magnetic Particles", International Journal of Modern Physics B, vol. 19, No. 7, 8 & 9, Apr. 10, 2005, pp. 1430-1436.*

Kagan I Ya et al., "Ferromagnitnyie Elektroprovodnyie Zhidkosti" Magnitnaya Gidrodinamika, vol. 6, No. 3, Apr. 15, 1970, pp. 155-157, XP008060629.

International Search Report dated Nov. 6, 2006 (three (3) pages).

F. E. Luborsky, "The Formation of Elongated Iron and Iron-Cobalt Particles by Electrodeposition into Mercury," *J. of the Electrochem. Soc.* 108(12):1138-1146 (1961).

S. W. Charles, et al., "The Preparation and Properties of a Stable Metallic Ferrofluid," *Thermomechanics of Magnetic Fluids: Theory and Applications*, ed. B. Berkovsky, Hemisphere Publ. Corp., Washington 1978, pp. 27-44.

I. Ya. Kagan, et al., "Ferromagnetic Electrically Conducting Liquids," (*Translated from Magnitnaya Gidrodinamika* 6(3):155-157, 1970), pp. 441-443 (1970).

S. Linderoth, et al., "New methods for preparing mercury-based ferrofluids," *J. Appl. Phys.* 69(8): 5124-5126 (Apr. 15, 1991).

* cited by examiner

*Primary Examiner* — Carol M Koslow
(74) *Attorney, Agent, or Firm* — Merchant & Gould

(57) ABSTRACT

The invention relates to a composite material formed by microparticles of magnetic material A and a conductive liquid B. The material is characterized in that the material A is chosen from magnetic compounds and magnetic alloys and is in the form of particles, the mean size of which is between 1 and 10 μm, and in that the support fluid B is a conductive fluid chosen from metals, metal alloys and salts that are liquid at temperatures below the Curie temperature of the material A, or from mixtures thereof.

22 Claims, No Drawings

CONDUCTING FLUID CONTAINING MICROMETRIC MAGNETIC PARTICLES

The present invention relates to a composite material formed by particles of magnetic material and a conductive liquid.

BACKGROUND OF THE INVENTION

Magnetorheological fluids are liquid materials formed by magnetic particles in stable suspension in a support liquid. These materials have a very low electrical conductivity when the support liquid is an ionic liquid, and they may be insulating when the support liquid is an organic solvent.

Various attempts have been made to confer a conductive character on magnetorheological materials for the purpose of broadening their field of application. For example, F. E. Luborsky (J. of the Electrochem. Soc., Vol. 108, No. 12, 1961, pp. 1138-1145) describes the introduction of Fe into mercury in an electrochemical cell, the cathode of which is a mercury film and the electrolyte is a solution of an iron salt. The intended aim is to produce a permanent magnet.

S. W. Charles, et al. [Thermomechanics of magnetic fluids (1975), Hemisph. Publ. Corp. Washington 1978, pp. 27-43] describes the preparation of a ferrofluid by a method consisting in introducing Fe electrochemically into Hg or into an Hg/Sn amalgam, using an electrolyte containing an Fe salt. The Fe particles formed on the surface of the cathode are subjected to stirring in order to promote their dispersion in the Hg or in the amalgam. It is observed that the addition of Sn to Hg significantly improves the stability of the ferrofluid system but a certain degree of agglomeration of the Fe particles persists.

Suspensions of nickel particles in a conductive liquid have been described by I. Ya. Kagan, et al (Magnitnaya Gidrodinamika, Vol. 6, No. 3, pp. 155-157, 1970). These suspensions were prepared by introducing nickel particles having a size of about 50 μm into a metallic liquid, namely tin, which is liquid at a temperature above 232° C., bismuth, which is liquid at a temperature above 271° C., or an In—Ga—Sn alloy denoted by Ingas, which is liquid at a temperature above 11° C. or 15.8° C. depending on the composition. According to the authors, the ferrofluid suspensions having these compositions could be obtained by simple mixing of the constituents, because there is a certain wettability of the nickel by the metallic liquids in question and because of the similar densities of nickel and said metallic liquids. However, such a method is not applicable to the production of a conductive ferrofluid in which the metal constituting the magnetic particles and the metal constituting the conductive liquid exhibit little or no mutual affinity and the wettability of the metal constituting the magnetic particles by the conductive liquid metal is low, or zero.

S. Linderoth, et al. (J. Appl. Phys. 68(8), 15/04/1991, pp. 5124-5126) describe two methods of preparing mercury-based ferrofluids. According to the first method, mixed (Fe—Co—B, Fe—Ni—B, Fe—B, Co—B or Ni—B) particles are prepared by adding an aqueous $NaBH_4$ solution drop by drop to an aqueous solution containing ions of the transition metals in question, mercury is then added to the aqueous suspension of mixed particles obtained, and the mixture is subjected to stirring. This first method makes it possible to obtain a suspension of the aforementioned mixed particles in Hg (on condition that the particles are not washed with distilled water before they are introduced into the Hg when they are Fe—Ni—B, Co—B or Ni—B particles). However, the $NaBH_4$ compound that is added is incorporated, by its nature, into the chemical composition of the final product, and the method cannot therefore be generalized to other "magnetic compound/conductive liquid" pairs. According to the second method, metallic iron is dissolved in concentrated HCl, $HgCl_2$ is added to the solution, the pH is adjusted to about 3 by the addition of an appropriate amount of a concentrated aqueous NaOH solution, and then $NaBH_4$ is added to reduce the assembly. In this method, the iron and mercury are generated simultaneously by a chemical process the evolution of which is not controlled. In the general case, it is not certain that there will always be particles, and alloys of uncontrolled composition may form. The method involves having ionic solutions of the metals in question, something which is obviously not always possible. Finally, $NaBH_4$ is a good reducing agent but is not necessarily suitable for all metals.

It is known to use fluids having magnetorheological properties in viscoelastic transmission systems such as, for example, shock absorbers, especially in motor vehicles, antiseismic devices, antivibration devices, bridge decks and clutches. The fluids generally used are formed by magnetic particles of micron size dispersed in liquids, such as synthetic oils or hydrocarbons of low volatility, silicone oils, or aqueous fluids for low-elongation applications with complete sealing. However, these fluids cannot be used in shock absorbers of devices that are subjected to high temperatures, especially above 200° C.

SUMMARY OF THE INVENTION

The object of the present invention is to provide a material capable of serving as a magnetorheological fluid that overcomes the drawbacks of the systems of the prior art, namely the temperature limitation.

For this purpose, the subject of the present invention is a method for producing a composite material, the material obtained, and its use as magnetorheological fluid.

DETAILED DESCRIPTION OF THE PREFERRED EMBODIMENTS

The method according to the present invention consists in introducing non-ionic magnetic particles, which become magnetic material A, into an electrically conductive fluid B, which method is implemented electrochemically in an electrochemical cell in which:

- the electrolyte consists of an ionically conductive medium containing the non-ionic magnetic particles that become magnetic material A. These particles have a mean diameter which is between 1 and 10 μm;
- the particles that become material A are nonionic in conductive fluid B;
- the cathode consists of a film of the conductive fluid B connected to a potential source capable of delivering a current density between 100 $mA/cm^2$ and 3 $A/cm^2$;
- the anode consists of a material that is nonoxidizable under the conditions of the method, for example platinum or vitreous carbon; and
- the cathode is subjected to a negative potential difference relative to the anode.

This configuration of an electrochemical cell is commonly referred to as a "mercury pool electrode".

The electrolysis may either be current-controlled, by controlling the variation in potential at the cathode, or potential-controlled, by controlling the potential relative to a reference electrode (using a control device of the potentiostat type). The potential applied to the cathode must in all cases be the most negative possible in order to reduce the interfacial tension between the materials A and B, but it must be limited so as not to induce other electrochemical reactions such as the excessive evolution of hydrogen or the formation of amalgams, detrimental to the efficiency and to the stability of the product.

The anode may be placed in a compartment separated from the cathode by a porous wall. The cell furthermore includes a reference electrode when the electrolysis is potential-controlled.

The particles that become magnetic material A may be chosen from magnetic metals and metal oxides and from magnetic alloys. Among metals and metal oxides, mention may be made of iron, iron oxide, cobalt and nickel. Among alloys, mention may be made of steel and alloys having a high magnetic permeability. An alloy having a high magnetic permeability is an alloy having an initial permeability of greater than 1000. Such alloys are described in particular in Chapter 2 of the work "Alliages magnétiques et ferrites", [*Magnetic alloys and ferrites*] by M. G. Say, published by Dunod, Paris, 1956. As examples of high-permeability alloys, mention may in particular be made of iron-silicon alloys and alloys consisting essentially of Ni and Fe, sold under the name Mu-metal® or Permalloy®. Amorphous magnetic alloys may also be mentioned, such as for example alloys of Fe, Co and Ni containing about 20% B, C, Si or P, and nanocrystalline magnetic alloys, such as for example Fe/Cu/Nb/Si/B alloys and Fe/Zr/B/Cu alloys.

The particles that become magnetic material A may be substantially spherical particles having a mean diameter, the size distribution of which is homogenous. They may be introduced into the liquid medium constituting the electrolyte in the form of two batches, the particles of one of the batches having a different mean size from that of the particles of the other batch. The mean particle size of the second batch may lie outside the 1 to 10 μm interval. The second batch may for example be formed by particles whose mean size lies in the interval from 0.5 to a few millimeters, for example from 1 to 2 mm.

The particles that become magnetic material A may furthermore be formed by a batch of particles that become a first magnetic material A and by a batch of particles that become a second magnetic material A' chosen from the group defined for A.

The particles may be used as defined above but they may also be used after they have been coated with a metal having an affinity for A in the conductive fluid B.

When implementing the method, the respective amounts of particles that become magnetic material A and of conductive fluid B that are used are such that the final particle concentration of magnetic material A in the conductive fluid B remains below the value above which the dispersion is no longer homogeneous or becomes pasty, which would result in precipitation, taking into account the degree of solubility of A in B. The determination of this value lies within the competence of a person skilled in the art.

The term "electrically conductive fluid" is understood to mean a fluid that has an electrical resistivity of less than about 1000 ohms per centimeter within the temperature range in which the electrolysis takes place.

The conductive fluid B is chosen from metals, metal alloys and salts that are liquids at temperatures below the Curie temperature of the material A, or from mixtures thereof.

When the electrically conductive fluid B is a metal, it may be chosen from metals that are liquids by themselves or in the form of mixtures of several of them at temperatures below the Curie point of the magnetic material A with which they are associated. As examples, mention may be made of Hg, Ga, In, Sn, As, Sb, Bi, alkali metals and mixtures thereof, particularly Ga, In, Sn, As, Sb, Li, K and Cs.

When the electrically conductive fluid B is a molten metal alloy, it may be especially chosen from In/Ga/As alloys, Ga/Sn/Zn alloys, Hg/Sn alloys, In/Bi alloys, Wood's alloy, Newton's alloy, Arcet's alloy, Lichtenberg's alloy and Rose's alloy. Some of these alloys are commercially available. The composition and the melting point of some of them are given below:

| Composition (% by weight) | $T_m$(° C.) |
|---|---|
| 21.5In—62.5Ga—16.0Sn | 10.7 |
| 17.6In—69.8Ga—12.5Sn | 10.8 |
| 82.0Ga—12.0Sn—6.0Zn | 17 |
| 67In—33Bi | 70 |
| Wood's alloy: 50Bi—25Pb—12.5Sn—12.5Cd | 70 |
| Newton's alloy: 50Bi—31.2Pb—18.8Sn | 97 |
| Arcet's alloy: 50Bi, 25Sn—25Pb | 98 |
| Lichtenberg's alloy: 50Bi—20Sn—30Pb | 100 |
| Rose's alloy: 50Bi—22Sn—28Pb | 109 |

When the conductive fluid B is a salt, it may be chosen from:

alkylammonium nitrates in which the alkyl group comprises from 1 to 18 carbon atoms, guanidinium nitrates, imidazolium nitrates and imidazolinium nitrates;

alkali metal chloroaluminates, which are liquids at temperatures above 150° C.; and salts comprising a $BF_4^-$, $PF_6^-$ or trifluoroacetate anion and a cation chosen from amidinium $[RC(=NR_2)—NR_2]^+$, guanidinium $[R_2N—C(=NR_2)—NR_2]^+$, pyridinium

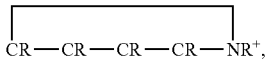

imidazolium

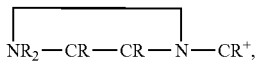

and imidazolinium

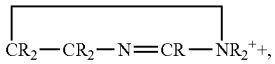

triazolium

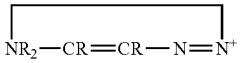

ions, in which each substituent R represents, independently of the others, H or an alkyl radical having from 1 to 8 carbon atoms, said salts having conductivities of up to 10 mS/cm and being very stable. As an example, mention may be made of 1-ethyl-3-methylimidazolium bis(trifluoromethylsulfonyl) imide.

When the electrically conductive fluid B consists of a given metal, one or more elements may be added to it which may form a stable liquid phase (or a liquid amalgam when said metal is mercury) and which stabilize the dispersion of the particles A within the conductive fluid, preventing them from aggregating. For example, if B is mercury, Sn, Ag, Cu, Cd, Zn, Tl, Pb, In, As or Sb may be added to it in a proportion that remains less than the value that would lead to the formation of a solid phase.

The presence of impurities is liable to significantly modify the interfacial properties between the magnetic material A and the conductive fluid B, and consequently the wettability of the material A by the conductive fluid B. If by implementing the method of the invention for a given pair A/B a suitable result is not obtained, it is recommended to check the nature and the level of impurities.

The particles that become magnetic material A may be introduced into the ionically conductive medium and then into the electrically conductive liquid B during the electrolysis, that is to say gradually until the desired concentration in B is obtained. In this case, the current density and/or the potential are modified at the same time as the particles that become magnetic material A are introduced, thereby making it possible, as the case may be, to introduce particles of A' that are different from the particles of A.

The ionically conductive medium is preferably a nonoxidizing medium. It may be formed by a solution of a nonoxidizing acid (for example HCl) or of a strong base in a solvent. The solvent may be water, a polar organic liquid or a molten salt. The polar organic liquid may be chosen from acetonitrile, acetone, tetrahydrofuran, dimethylformamide (DMF), dimethylsulfoxide (DMSO), propylene carbonate (PC), dimethyl carbonate and N-methylpyrrolidone. The molten salt may be chosen from those defined above as electrically conductive fluid.

The potential source to which the cathode is connected must be capable of delivering a current density of at least around 100 mA/cm$^2$ of cathode.

When the electrochemical cell is potential-controlled, it necessarily includes a reference electrode, and the potential differential difference between the cathode and said reference electrode is fixed within a range such that the interfacial tension between A and B is reduced so as to allow wetting of the particles A by the liquid B. For example, when the particles A are Fe particles and the liquid B is Hg, the voltage is between −1 V and −3 V relative to the reference electrode.

When the electrochemical cell operates in galvanostatic mode, that is to say when it is current-controlled, and when it includes a reference electrode, it is necessary to impose action thresholds that reduce the current so that the potential difference between the cathode and the reference electrode is limited to the range defined in the case in which the cell is potential-controlled.

When the electrochemical cell is current-controlled without a control device and when it does not include a reference electrode, it is necessary to monitor the total potential relative to a predetermined limit, for example using a temporary reference electrode.

In practice, when operating in current-controlled mode, it is preferable to use an electrochemical cell that includes a reference electrode.

In a particularly preferred way of implementing the electrochemical preparation, a magnetic field is applied perpendicular to the plane of the cathode. In another method of implementation, other types of action on the material may be obtained by superposing pulses or AC components on the current or potential controlling the process, in the absence or in the presence of said perpendicular magnetic field.

At the end of the process, the conductive fluid constituting the cathode is highly enriched with magnetic particles A and constitutes the electrically conductive magnetorheological material of the invention.

The method of the present invention is particularly useful for preparing a composite material from particles that become a magnetic material and from an electrically conductive fluid when the material constituting the magnetic particles and the material constituting the electrically conductive fluid exhibit little or no mutual affinity and when the magnetic material is at best only weakly wettable by the electrically conductive fluid.

A composition material according to the present invention is formed by a support fluid B and particles of magnetic material A, wherein:

- the material A is chosen from magnetic metals, magnetic metal oxides and magnetic alloys and is in the form of particles, the mean diameter of which is between 0.1 and 10 μm; and
- the support fluid B is a conductive fluid chosen from metals, metal alloys and salts that are liquids at temperatures below the Curie temperature of the material A, or from mixtures thereof.

A material according to the present invention is compatible with high operating temperatures, it has a high electrical conductivity and it has a high thermal conductivity, which is favorable to extracting the heat produced by very intensive operating regimes at high temperature. Although heterogeneous, it may remain stable owing to the good wetting of A by B when the densities are close.

As examples of magnetic material A, mention may be made of the magnetic metals and metal oxides and the magnetic alloys defined above.

The material A is preferably formed by particles having a mean diameter, the size distribution of which is homogenous.

It may furthermore be formed by two batches, the particles of one of the batches having a different mean size from that of the particles of the other batch. The mean size of the particles of the second batch may lie outside the 1 to 10 μm interval. A material may for example contain particles whose mean size lies within the 1 to 10 μm interval and particles whose mean size lies in the interval from 0.5 to a few millimeters, for example 1 to 2 mm.

The particles of magnetic material may furthermore be formed by a batch of a first magnetic material A and by a batch of a second magnetic material A' chosen from the group defined for A.

In a composite material obtained by the method of the invention, the amount of magnetic particles is at most equal to the threshold value above which the dispersion is no longer homogeneous or becomes pasty.

In one embodiment, the conductive fluid B is chosen from Ga, In, As, Sb, Li, K and Cs. In another embodiment, the electrically conductive fluid B is a molten metal alloy chosen from In/Ga/As alloys, Ga/Sn/Zn alloys, In/Bi alloys, Wood's alloy, Newton's alloy, Arcet's alloy, Lichtenberg's alloy and Rose's alloy. In a third embodiment, the electrically conductive fluid B is a salt chosen from:

- alkylammonium nitrates in which the alkyl group comprises from 1 to 18 carbon atoms, guanidinium nitrates, imidazolium nitrates and imidazolinium nitrates;
- alkali metal chloroaluminates, which are liquids at temperatures above 150° C.; and
- salts comprising a $BF_4^-$, $PF_6^-$ or trifluoroacetate anion and a cation chosen from amidinium $[RC(=NR_2)—NR_2]^+$, guanidinium $[R_2N—C(=NR_2)—NR_2]^+$, pyridinium

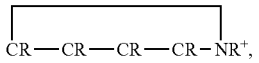

imidazolium

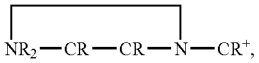

imidazolinium

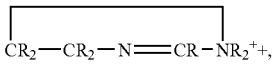

and triazolium

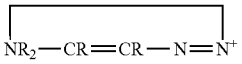

ions, in which each substituent R represents, independently of the others, H or an alkyl radical having from 1 to 8 carbon atoms.

As examples of composite materials obtained by the method according to the invention, mention may be made of the following materials:

| | |
|---|---|
| Fe or steel particles in | Hg |
| Fe or steel particles in | Ga |
| Co or Ni particles in | Hg |
| Fe particles in | Ga + Sn |
| Fe particles in | Wood's alloy |
| Iron/silicon alloy particles in | Wood's alloy. |

The composite materials of the present invention are electrically conductive magnetorheological materials that can be advantageously used in many fields, such as nanotech-nologies, micromachines, magnetohydrodynamics and microfluidics.

Of course, they may be used for various applications of conventional magnetorheological materials that do not exhibit electrical conductivity, namely in viscoelastic transmission systems such as shock absorbers, especially in motor vehicles, antiseismic devices, antivibration devices, bridge decks and clutches, on condition however that these applications are compatible with microparticles.

The present invention is illustrated below by a few specific exemplary embodiments to which however the invention is not limited.

The following starting products were used in the examples:

Mercury

Gallium

Powdered iron, sold under the reference 312-31 (reduced iron for analysis) by Riedel-de Haën, consisting of spherical particles having a diameter of about 10 μm 10006 steel balls (made of iron with 1% carbon and 1% chromium) with a diameter of 1.5 mm Wood's alloy InGaSn (21.5/62.5/16) alloy Tin Powdered iron/silicon alloy.

The materials were prepared in an electrochemical cell which was connected to a potential source and provided with stirring means, and in which the cathode was formed by a layer of the electrically conductive fluid B, a platinum electrode provided the contact with the cathode, a second platinum electrode operated as anode, and a calomel electrode operated as reference electrode.

Example 1

Fe/Hg Magnetorheological Material

Preparation of the Material:

5.261 g of mercury (material B) were placed in the bottom of the cell, 10 ml of 0.1M $HClO_4$ were added and the mixture was heated. The potential source generated a potential difference of 4 V between the two platinum electrodes, which induced a current of around 20 mA. Next, 0.528 g of powdered iron was added in doses of 20 mg every 10 minutes. The potential difference between the mercury and the calomel reference electrode remained around −1.5 volts over the duration of the operation. The layer of mercury was subjected to slight stirring in order to make it easier to incorporate the iron particles into the mercury layer and to prevent the coarsening of the hydrogen bubbles at the surface of the mercury.

Characterization of the Material Obtained:

The volume fraction of iron in the material obtained was 0.14±0.01.

The measured saturation magnetization of this material was 266 kA/m.

The initial susceptibility at low magnetic field was 1.86.

The electrical conductivity, measured for a specimen having a volume fraction of 10%, was 65 μΩ·cm with an estimated uncertainty of ±15%.

Example 2

Fe/Ga Magnetorheological Material

Preparation of the Material:

5.2 g of gallium (material B) were placed at the bottom of the cell, 10 ml of 0.1M HCl were added and the mixture was heated to a temperature of 35° C. and then a potential difference of 10 V was applied between the two platinum electrodes. Next, 0.76 g of powdered iron was added in five fractions, the additions being spaced apart by 10 minutes. At each addition, a magnet was used to bring the iron beneath the gallium, which was subjected to slight stirring using the magnet.

Characterization of the Material Obtained:

The volume fraction of iron in the material obtained was 0.1.

The measured saturation magnetization of the material was 190 kA/m.

The initial susceptibility at low magnetic field was 1.

The melting point was between 27 and 27.5° C. and the specimen was able to remain supercooled down to about 22° C.

The electrical conductivity was measured using a "4-point" conductivity cell constructed for liquids of low conductivity, with a resolution of 15±10 μΩ·cm. It was very close to the limiting value that could be measured by said cell and differed very little from that of pure gallium, around 20 μΩ·cm approximately.

Example 3

Fe/Wood's Alloy Magnetorheological Material

Preparation of the Material:

9 g of Wood's alloy (material B) were placed at the bottom of the cell, 10 ml of 0.1M HCl were added, the mixture was heated to a temperature of 80° C. and then a potential difference of 4.5 V was applied between the two platinum electrodes. Next, 0.972 g of powdered iron was added in 5 fractions, the additions being spaced apart by 5 minutes.

Characterization of the Material Obtained:

The volume fraction of iron in the material obtained was around 0.1.

The saturation magnetization of the material was 150 kA/m.

The initial susceptibility at low magnetic field was 0.57.

The melting point of the material was 71.6° C.±0.2° C., and it was possible to keep it supercooled down to about 68° C.

Example 4

Iron/InGaSn Alloy Magnetorheological Material

Preparation of the Material:

3.6 g of InGaSn (21.5/62.5/16) alloy which had a melting point of 10.7° C. (material B) was placed in the bottom of the cell and 10 ml of 0.1M HCl were added. The mixture was heated to a temperature of 55° C. and then a potential difference of 5 V was applied between the two platinum electrodes, and a potential of 10 V for 10 s every 2 minutes. Next, 0.325 g of powdered iron was added in 4 fractions, the additions being spaced apart by 5 minutes.

Characterization of the Material Obtained:

The volume fraction of iron in the material obtained was around 0.065.

The saturation magnetization of the material was 113 kA/m.

The initial susceptibility at low magnetic field was 0.55.

Example 5

Fe/Ga+ Sn Magnetorheological Material

Preparation of the Material 5.2 g of gallium (material B) were placed in the bottom of the cell and 10 ml of 0.1M HCl were added. The mixture was heated to a temperature of 35° C., 0.145 g of tin was added and then a potential difference of 4.5 V was applied between the two platinum electrodes. Next, 0.3 g of powdered iron was added in 2 fractions, the additions being spaced apart by 10 minutes. At each addition, a magnet was used to bring the iron beneath the gallium, which was also regularly stirred with this magnet. There was a further addition of 0.17 g of tin, followed by 0.64 g of iron in 3 additions. The HCl concentration was readjusted (HCl was consumed during the prolonged electrolysis, causing the current to decrease) by adding a suitable amount. The voltage difference between the two platinum electrodes was raised to 8 V.

Characterization of the Material:

The volume fraction of iron in the material obtained was around 0.1.

The saturation magnetization of the material was 182 kA/m.

The initial susceptibility at low magnetic field was 1.1.

Example 6

Iron/Steel/Hg Magnetorheological Material

Preparation of the Material:

8.694 g of mercury (material B) were placed in the bottom of the cell, 10 ml of 0.1M HCl were added and the mixture was heated to 50° C. The potential source generated a potential difference of 6 V between the two platinum electrodes, inducing a current of around 250 mA. Next, 0.2 g of steel balls and 0.54 g of powdered iron were added. The layer of mercury was subjected to slight stirring to make it easier to incorporate the magnetic materials in the mercury layer and to prevent coarsening of the hydrogen bubbles at the surface of the mercury.

Characterization of the Material Obtained:

The volume fraction of iron in the material obtained was 0.127.

The measured saturation magnetization of this material was 250 kA/m.

The initial susceptibility at low magnetic field was 1.45.

Example 7

Iron/Steel/Ga Magnetorheological Material

Preparation of the Material:

4.86 g of gallium (material B) were placed in the bottom of the cell and 10 ml of 0.2M HCl were added. The mixture was heated to a temperature of 50° C. and then a potential difference of 11 V was applied between the two platinum electrodes. Next, 0.2 g of steel balls and 0.142 g of iron powder were added. A magnet was then used to bring the iron beneath the gallium, which was subjected to slight stirring using the magnet.

Characterization of the Material Obtained:

The volume fraction of iron in the material obtained was 0.04.

The measured saturation magnetization of this material was 72 kA/m.

The initial susceptibility at low magnetic field was 0.42.

Example 8

FeSi/Wood's Alloy Magnetorheological Material

Preparation of the Material:

5.25 g of Wood's alloy (material B) were placed in the bottom of the cell and 10 ml of 0.1M HCl were added. The mixture was heated to a temperature of 75° C. and then a potential difference of 6 V was applied between the two platinum electrodes. Next, 0.37 g of powdered iron/silicon alloy (mean size of 10 microns) were added in 5 fractions, the additions being spaced apart by 5 minutes. After each addition, the potential difference between the two electrodes was raised to 12 V for 30 s.

Characterization of the Material Obtained:

The volume fraction of magnetic material in the material obtained was around 0.08.

The saturation magnetization of the material was 137 kA/m.

The initial susceptibility at low magnetic field was 1.8.

The invention claimed is:

1. A method for the preparation of a conductive magnetorheological material comprising a magnetic material A and an electrically conductive fluid B, comprising:

introducing magnetic particles, which become a magnetic material A, into an electrically conductive fluid B, and applying a current in the range of 0.1 to 3 A/cm$^2$;

wherein the method is implemented electrochemically in an electrochemical cell, wherein:

the electrochemical cell is connected to a potential source;

the electrolyte consists of an ionically conductive medium containing the particles, the mean diameter of which is between 0.1 and 10 μm;

the particles are nonionic in electrically conductive fluid B;

the cathode consists of a film of the conductive fluid B connected to a potential source capable of delivering a current density between 0.1 and 3 $A/cm^2$, a first electrode providing contact with the cathode, a second electrode operating as the anode, and a third electrode as a reference electrode;

the anode consists of a material that is nonoxidizable under the conditions of the method; and the cathode is subjected to a negative potential difference relative to the anode.

2. The method as claimed in claim 1, wherein the particles are selected from the group consisting of iron, iron oxide, cobalt, nickel and magnetic alloys.

3. The method as claimed in claim 1, wherein the particles are substantially spherical.

4. The method as claimed in claim 1, wherein the particles are in the form of two batches of particles, the particles of one of the batches having a different mean size from that of the particles of the other batch.

5. The method as claimed in claim 4, wherein the mean size of the particles of the second batch lies outside the 1 to 10 μm interval.

6. The method as claimed in claim 1, wherein the particles are formed by a batch of particles that become a first magnetic material A and by a batch of particles that become a second magnetic material A' chosen from the group defined for A.

7. The method as claimed in claim 1, wherein the amount of magnetic particles is at most equal to the threshold value above which the dispersion is no longer homogeneous or solids precipitate.

8. The method as claimed in claim 1, wherein the ionically conductive medium is formed by a solution of a nonoxidizing acid or of a strong base in a solvent.

9. The method as claimed in claim 8, wherein the solvent is selected from the group consisting of water, polar organic liquids and molten salts.

10. The method as claimed in claim 1, wherein the electrically conductive fluid B is selected from the group consisting of metals, metal alloys and salts that are liquids at temperatures below the Curie temperature of the material A, and mixtures thereof.

11. The method as claimed in claim 10, wherein the electrically conductive fluid B is a metal selected from metals that are liquids by themselves or in the form of mixtures of several of them at temperatures below the Curie point of the magnetic material A with which they are associated.

12. The method as claimed in claim 11, wherein the electrically conductive fluid B is selected from the group consisting of Ga, In, As, Sb, Li, K and Cs, and mixtures thereof.

13. The method as claimed in claim 10, wherein the electrically conductive fluid B is a molten metal alloy selected from the group consisting of In/Ga/As alloys, Ga/Sn/Zn alloys, In/Bi alloys, Wood's alloy, Newton's alloy, Arcet's alloy, Lichtenberg's alloy and Rose's alloy.

14. The method as claimed in claim 10, wherein the electrically conductive fluid B is a salt selected from the group consisting of:

alkylammonium nitrates in which the alkyl group comprises from 1 to 18 carbon atoms, guanidinium nitrates, imidazolium nitrates and imidazolinium nitrates;

alkali metal chloroaluminates, which are liquids at temperatures above 150° C.; and salts comprising a $BF_4^-$, $PF_6^-$ or trifluoroacetate anion and a cation chosen from amidinium $[RC(=NR_2)—NR_2]^+$, guanidinium $[R_2N—C(=NR_2)—NR_2]^+$, pyridinium

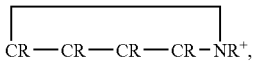

imidazolium

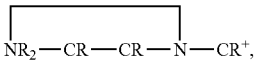

imidazolinium

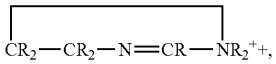

and triazolium

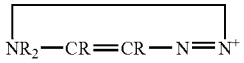

ions, in which each substituent R represents, independently of the others, H or an alkyl radical having from 1 to 8 carbon atoms.

15. The method as claimed in claim 10, wherein the electrically conductive fluid B is selected from the group consisting of Hg, Sn, Na, Bi, Hg/Sn alloys and In/Ga/Sn alloys.

16. The method as claimed in claim 15, wherein one or more elements are added to the metal forming the electrically conductive fluid B, which elements may form a stable liquid phase or a liquid amalgam when said metal is mercury.

17. A composite material comprising a magnetic material A and a liquid support B, wherein:

the material A is selected from the group consisting of magnetic metals, magnetic metal oxides and magnetic alloys and is in the form of particles, the mean diameter of which is between 0.1 and 10 μm; and the support fluid B is a salt selected from the group consisting of:

alkylammonium nitrates in which the alkyl group comprises from 1 to 18 carbon atoms, guanidinium nitrates, imidazolium nitrates and imidazolinium nitrates;

alkali metal chloroaluminates, which are liquids at temperatures above 150° C.; and salts comprising a $BF_4^-$, $PF_6^-$ or trifluoroacetate anion and a cation chosen from amidinium $[RC(=NR_2)—NR_2]^+$, guanidinium $[R_2N—C(=NR_2)—NR_2]^+$, pyridinium

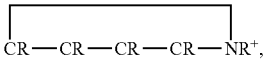

imidazolium

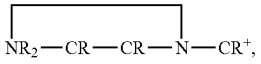

imidazolinium

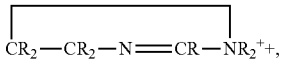

and
triazolium

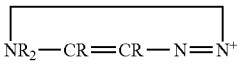

ions, in which each substituent R represents, independently of the others, H or an alkyl radical having from 1 to 8 carbon atoms;

wherein the composite material comprises two batches of magnetic material particles, the particles of one of the batches having a different mean size from that of the particles of the other batch.

18. The composite material as claimed in claim 17, wherein the magnetic material A is selected from the group consisting of iron, cobalt, nickel, iron oxide and an Fe/Si alloy.

19. The composite material as claimed in claim 17, wherein the amount of magnetic particles is at most equal to the threshold value above which the dispersion is no longer homogeneous or solids precipitate.

20. The composite material as claimed in claim 17, containing substantially spherical particles of magnetic material.

21. The composite material as claimed in claim 17, wherein the mean size of the particles of the second batch lies outside the 1 to 10 μm interval.

22. The composite material as claimed claim 17, wherein the magnetic material particles may be formed by a batch of a first magnetic material A and by a batch of a second magnetic material A' chosen from the group defined for A.

* * * * *